US005718434A

United States Patent [19]

Alward

[11] Patent Number: 5,718,434

[45] Date of Patent: Feb. 17, 1998

[54] BULLET TRAP

[75] Inventor: Phil N. Alward, Allendale, N.J.

[73] Assignee: Wilderness Expeditions, Inc., Hawthorne, N.J.

[21] Appl. No.: 420,320

[22] Filed: Apr. 10, 1995

[51] Int. Cl.[6] ..... F41J 1/12

[52] U.S. Cl. ..... 273/410; 89/36.02

[58] Field of Search ..... 273/410; 89/36.02

[56] References Cited

U.S. PATENT DOCUMENTS

| | | | |
|---|---|---|---|
| 2,356,992 | 7/1944 | Gilson . | |
| 2,420,304 | 5/1947 | Diem . | |
| 2,422,284 | 5/1947 | Andresen et al. . | |
| 2,525,843 | 3/1950 | Walker . | |
| 2,631,454 | 3/1953 | Shepard . | |
| 2,772,092 | 2/1956 | Nikoden . | |
| 2,812,660 | 11/1957 | Marden et al. . | |
| 3,737,165 | 6/1973 | Pencyla | 273/410 |
| 4,475,734 | 10/1984 | Clarke, III et al. | 273/410 |
| 4,512,585 | 4/1985 | Baravaglio | 273/410 |
| 5,070,763 | 12/1991 | Coburn | 89/36.02 |
| 5,259,291 | 11/1993 | Wilson | 89/36.02 |
| 5,400,692 | 3/1995 | Bateman | 273/410 X |
| 5,535,662 | 7/1996 | Bateman | 89/36.02 |
| 5,618,044 | 4/1997 | Bateman | 273/410 |

OTHER PUBLICATIONS

Drawings and Brochure, Model 2200 Escalator Bullet Trap, Detroit Armor Corp. (4 pages). Publication Date Unknown.

Drawings and Brochure, Bullet Trap, Caswell Equipment Company, Inc. (4 pages). Publication Date Unknown.

Brochure, "PARASHOOT", Unisys Corporation (1 page). Publication Date Unknown.

Brochure, "Wet" Range & Trap Systems; Passive Bullet Traps Inc. (1 page). Publication Date Unknown.

*Primary Examiner*—William H. Grieb

*Attorney, Agent, or Firm*—Fitzpatrick, Cella, Harper & Scinto

[57] ABSTRACT

A bullet trap for use in pistol and rifle ranges employs one or more deflecting plates situated so that bullets entering the bullet trap strike the deflecting plates at an angle of between 15 and 20 degrees. The low angle of impact reduces wear and pitting of the deflecting plates which would occur if higher impact angles were employed, and reduces the production of airborne lead particles. The deflecting plates include curved portions which direct bullets toward a back wall and a final impact plate. A liquid lubricant spray mist is employed which coats the bullet trap surfaces, further reducing wear to bullet trap components. The lubricant mist also traps airborne lead particles and carries them to a collection tray for reprocessing. Spent bullets are also collected in the collection tray. Leading edges of the deflecting plates are hardened to better withstand impact with bullets and employ a unique geometry which splits bullets with a minimum of lead dust production.

19 Claims, 3 Drawing Sheets

Fig. 3
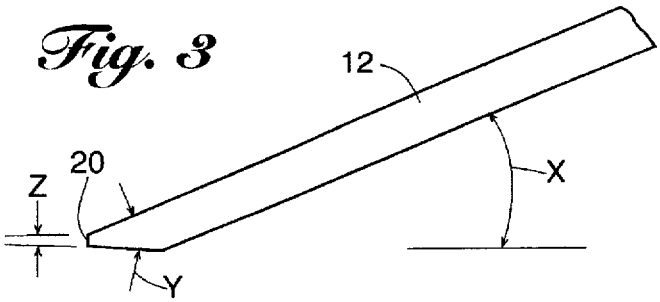
Fig. 4
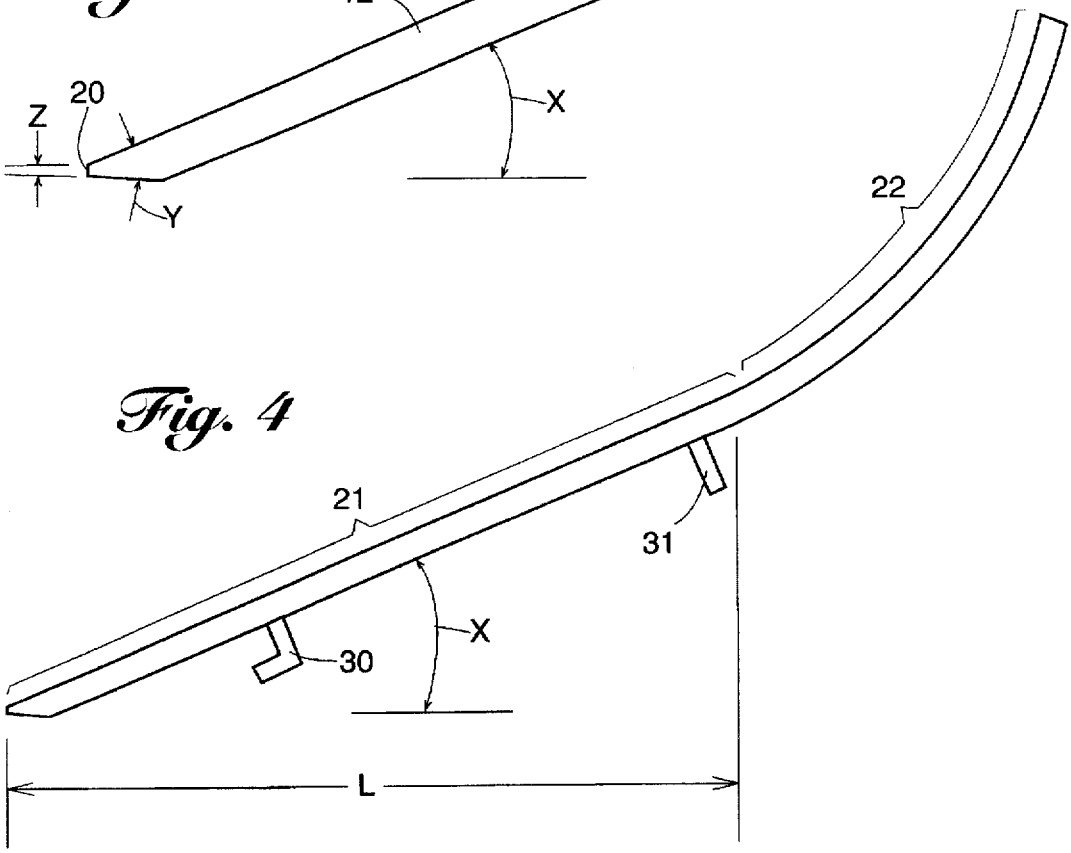
Fig. 6
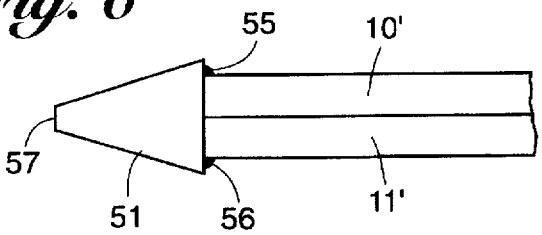
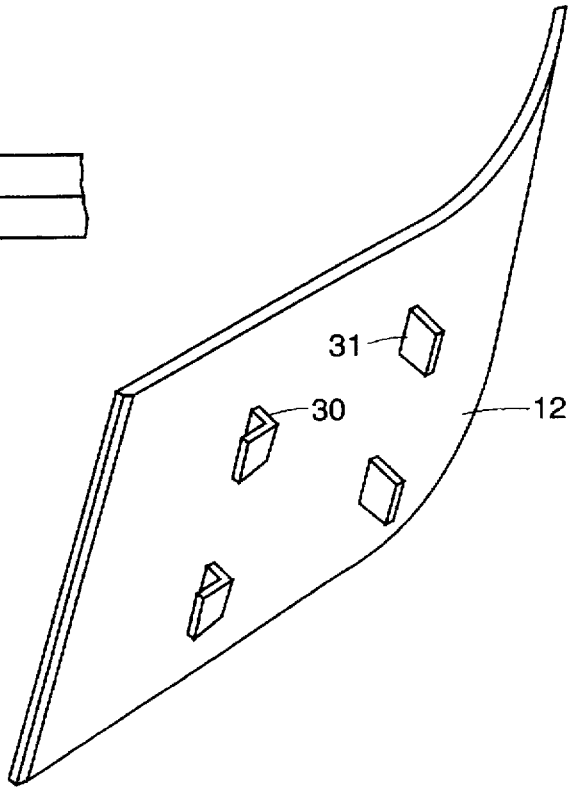
Fig. 5

BULLET TRAP

BACKGROUND OF THE INVENTION

1. Field of the Invention

This invention relates to bullet traps and in particular to bullet traps for use in pistol and rifle ranges. The invention relates further to bullet traps capable of safely trapping bullets travelling in excess of 1500 feet per second without sustaining significant damage and which minimize the production of airborne lead dust.

2. Description of the Related Art

Bullet traps per se are well-known and have been used for many years. Typically, such traps are used by firearm manufacturers, by training facilities for military or police personnel, and by recreational target shooting facilities. Bullet traps are of widely varying configurations, from wood boards, to sand-filled traps, to complex deceleration chambers.

By way of example, a known sand-type bullet trap typically consists of a quantity of sand in a hardwood box set against a concrete wall. This type of trap poses several problems. As the trap begins to fill with lead bullets, there is a risk that an incoming bullet will strike a bullet lodged in the sand and ricochet in a dangerous manner. Therefore, the sand must be changed periodically, requiring extensive labor at considerable cost. In addition, the sand is not easily disposed of because it is contaminated with lead. The lead must be removed from the sand, which can be extremely difficult since lead particles can fuse with silica, created when a bullet strikes the sand. Moreover, the lead that is reclaimed is not easily reprocessed because of sand contamination.

Mechanical bullet traps having deflecting plates or deceleration chamber designs are also in existence. Representative of the deflecting plate or deceleration chamber type bullet traps are the traps disclosed in U.S. Pat. Nos. 2,772,092 (Nikoden), 3,737,165 (Pencyla), 4,512,585 (Baravaglio), and 5,070,763 (Coburn).

Existing mechanical bullet traps have proved inadequate at solving the problem of safely minimizing lead contamination to the environment with an economical, easily maintained device. For example, deflecting plate/deceleration chamber designs have employed large quantities of expensive high strength steel necessitated by the high bullet impact angles employed in the designs. In addition, the construction of deceleration chambers such as those used in several of the above-cited patents are complex and therefore expensive to build. Known deceleration chambers also suffer from the fact that their designs make inspection and replacement of parts difficult or impossible without a complete disassembly of the bullet trap. Moreover, many of the known bullet traps fail to provide any means for preventing the release of lead particles and dust into the atmosphere.

SUMMARY OF THE INVENTION

In view of increasingly stringent standards regarding the discharge of lead into the environment, the known devices for trapping lead bullets are inadequate. The present invention employs a method of trapping bullets which greatly reduces the production of lead dust and which also traps any lead dust that is created, transporting it to a convenient reclaiming area. Therefore, the design is far more environmentally clean than known devices.

In addition, the design is far more cost effective than known devices because it reduces the need for the use of high strength steel on the impact surfaces. The elimination of high strength steel is predicated on five features of a preferred embodiment of the invention. First, a modular design with replaceable deflecting plates is employed. Second, the deflecting plates have a novel combination of shallow depths and shallow deflecting angles to reduce impact forces and wear on critical trap components. Third, the leading edges of critical trap components subject to direct impact with bullets are shaped to split bullets cleanly. This feature also helps to further reduce the creation of lead dust. Fourth, leading edges of components subject to direct impact from bullets can be hardened locally to high levels. Fifth, a lubricating mist is applied to the impact surfaces.

More particularly, the components of the bullet trap of the present invention that most often receive direct impact from bullets and may therefore most quickly wear out and need replacement are the deflecting plates. In the present invention, the deflecting plates are easily removed and replaced as a result of the simple design of the present invention as compared to known devices. The simplified structure of the present invention also ensures that there are no hidden surfaces subject to damage by high impact bullet action. By eliminating such hidden surfaces, inspection of the structure for evidence of wear or failure is greatly simplified and safety is improved.

In addition, the deflecting plates within the trap are placed at a shallow angle on the order of 15 to 20 degrees with respect to the line of fire. By employing such a shallow angle the trajectory of incoming bullets upon first contact with deflecting plates is changed very little. As a result, the deflecting plates do not absorb excessive energy from the bullet at the point of contact as compared to known devices and do not need to be as hard as they would if they were deflecting the bullets to a greater extent. The shallow angle also ensures that bullets remain in contact with the deflecting plates following initial impact rather than bouncing or ricocheting, as would occur in known devices employing less shallow angles. Since bullets remain in continuous contact with the deflecting plates following initial impact, destruction of the deflecting plates through repeated high angle impacts with bullets does not occur. Thus, the deflecting plates can be constructed of less costly steel having a lower hardness than that employed in known devices.

Most of the bullets entering the bullet trap of the present invention will strike the deflecting plates on their sloping faces, which have the low incidence angle discussed above. However, an occasional bullet will strike the leading edge of a deflecting plate. In known devices, the components of the bullet trap have been made of expensive tough steel, so that the leading edges of the deflecting plates would not appreciably deform when struck by a bullet. This is, of course, costly. The present invention allows for the use of less expensive steel as a result of two design features. First, the leading edges of the deflecting plates are hardened so as to be better able to withstand the impact of the incoming bullets without deformation. Second, the leading edges have a wedge shaped cross section which causes the bullet to split cleanly. Thus, energy is expended splitting the bullet, rather than deforming the deflecting plate. The net result is that a less expensive steel can be employed.

In one embodiment of the invention, a high temperature silicone lubricant is sprayed in a shower from nozzles in the top of the bullet trap. This lubricant coats the faces of the deflecting plates, further reducing the stress and wear to deflecting plates which results from contact with incoming bullets. In this way the useful life of the deflecting plates is further extended.

The silicone lubricant shower also traps any lead dust that is generated, removing it from the air in the vicinity of the bullet trap and carrying it down to a collection basin. Thus, creation of lead dust from the bullet trap is greatly reduced. The lubricant provides the further benefit of coating the deflecting plates so they are protected from oxidation. This allows for the use of inexpensive steel which would otherwise be susceptible to corrosion. The silicone lubricant collects for recirculation in a tray at the bottom of the bullet trap where the spent bullets are also collected for safe retrieval.

More specific details of various preferred features of the apparatus will be set forth hereinafter.

There has thus been outlined rather broadly some more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the realization of other structures for carrying out the several purposes of the invention. It is important, therefore, that the claims be regarded as including such equivalent constructions as do not depart from the spirit and scope of the invention.

BRIEF DESCRIPTION OF THE DRAWINGS

FIG. 3 is an enlarged fragmentary side view of the leading edge of a deflecting plate.

FIG. 4 is a side view of a deflecting plate.

FIG. 5 is a perspective view of the underside of a deflecting plate.

FIG. 6 is an enlarged fragmentary top view of the leading edges of side walls of adjoining bullet traps in accordance with the present invention.

DESCRIPTION OF THE PREFERRED EMBODIMENT

Figure 1:
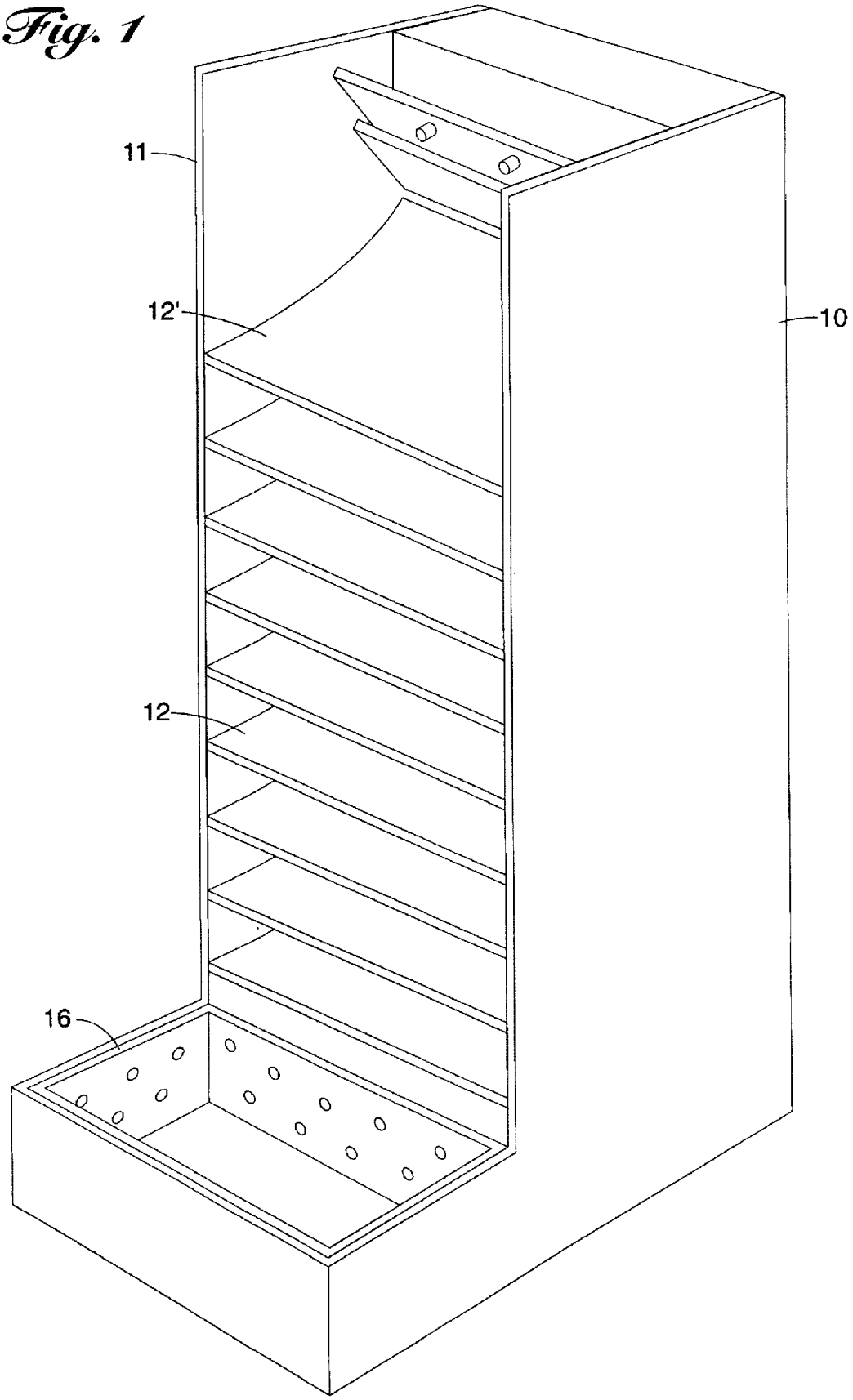
FIG. 1 is a perspective view of the bullet trap of the present invention.
Figure 2:
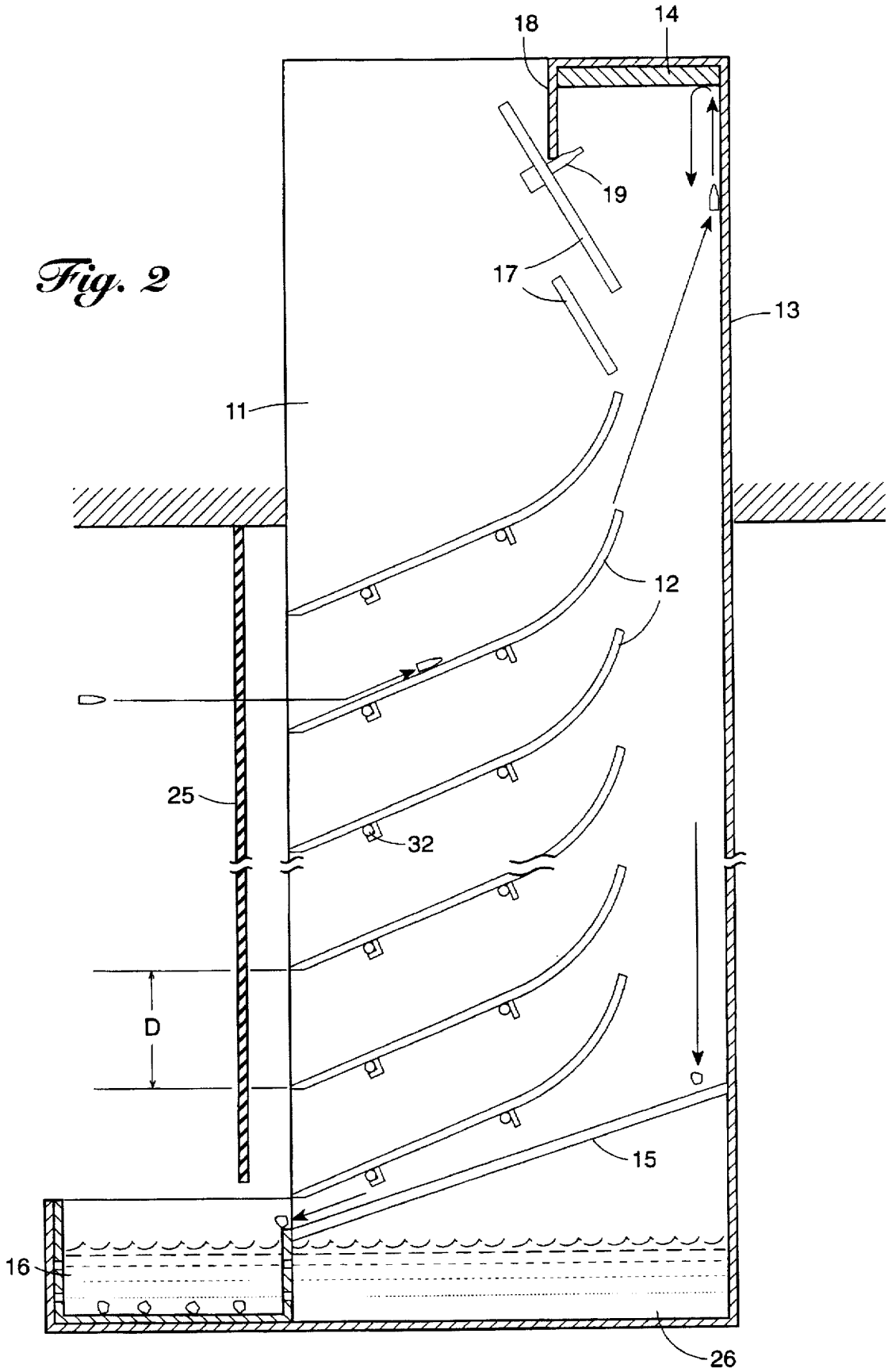
FIG. 2 is a vertical cross-sectional side view of the bullet trap of the present invention.

Referring to FIGS. 1 and 2, a steel bullet trap structure pursuant to and embodying features of the present invention is depicted including side walls 10 and 11, a back wall 13 and a final impact plate 14. Removably mounted between the side walls 10 and 11 are a plurality of vertically spaced deflecting plates 12. The ceiling of the room in which the trap is used should also be appropriately provided with steel plates disposed at a height which is below the level of the uppermost portion of the uppermost plate 12'.

Referring to FIGS. 3 and 4, the deflecting plates 12 have a leading edge 20, a front flat section 21 and a curved rear section 22. The transition from the flat section to the curved section is a smooth one, so that a bullet travelling along the upper face of the deflecting plate will not encounter any obstacle upon moving from the flat section to the curved section. This is important because any abrupt change in slope might cause the bullet to begin to tumble or bounce. If that occurs, more of the energy of the bullet will be transferred to the deflecting plate 12, causing it to wear more quickly than if there were constant contact between the bullet and the plate.

A bullet entering the bullet trap will strike a deflecting plate 12 either on its top sloping surface 21 or at its leading edge 20. The inventor has discovered that when the angle X of the front flat section 21 of the deflecting plate is on the order of 15 to 20 degrees from the path of the bullet, the bullet will not bounce, ricochet or tumble. Instead, it will begin to slide along the face of the deflecting plate. This is greatly preferred to tumbling, because, as stated, much less energy is transferred to the deflecting plate from the bullet when the bullet is sliding. Since the deflecting plate absorbs less energy from the bullet in the present invention than in the prior art devices, a plate of mild steel, such as hot-rolled steel, may be employed, rather than more expensive tougher steel. The distance D between deflecting plates is such that a bullet travelling along a horizontal path will not directly strike any curved rear sections of the deflecting plates. Instead, a bullet would have to strike either the leading edge 20 of the flat section or the flat section 21 itself. This is preferred because if the bullet were allowed to strike the curved section, the angle of incidence between the bullet and the deflecting plate would be more than 20 degrees and the surface of the plate would be more easily marred.

In the preferred embodiment, an angle of 18 degrees has proven to be optimal. At 18 degrees, there is almost no incidence of bouncing or tumbling. Angles of less than 18 degrees are also suitable. However, with shallower angles of deflection X, the distance D between deflecting plates must be decreased to prevent bullets from striking the curved sections of the deflecting plates, resulting in an excessive number of deflecting plates, or the length L of the deflecting plates must be increased, making the bullet trap larger and more costly to build.

Should the bullet strike the leading edge 20 of the deflecting plate, the geometry of the leading edge is such that the bullet is split with minimal fracture or ricochet. Referring to FIG. 3, the inventor has discovered that when the leading edge 20 of the deflecting plate is wedge-shaped, or chamfered, so that the angle Y between opposite faces of the wedge is approximately 30 degrees, an optimal design is achieved. As can be seen in FIG. 3, the face of the wedge on the top side of the deflecting plate is flush with and at the same angle as the top of the deflecting plate, whereas the bottom face of the wedge is at an angle of 30 degrees from the top face of the wedge. At this angle incoming bullets tend to split cleanly, with little fragmentation and consequent creation of lead dust. In addition, energy is expended splitting the bullet rather than deforming the deflecting plate. Furthermore, the bullet fragment that remains on the top side of the deflecting plate tends, in many cases, to continue to ride along the top portion of the deflecting plate, rather than bouncing or ricocheting, which as discussed above, is detrimental to the deflecting plate.

The leading edge 20 of the deflecting plate 12 can be formed with a sharp edge, but a blunt face is preferred since it is less likely to deform when hit with a bullet. In the preferred embodiment, the deflecting plate is made from ¼ inch hot-rolled steel plate and the width Z of the blunt face of the leading edge is 1/16 inch.

The leading edge 20 of the deflecting plate 12 can also be flame hardened through known techniques. According to the present invention, when the leading edge having the wedge shape as described above is flame hardened to a hardness of 55 Rockwell, it is better able to withstand constant direct bullet impact without noticeable deformation or degradation. In particular, such a leading edge will withstand an impact from a bullet travelling at 1500 feet per second without deformation.

As seen in FIG. 4, the deflecting plate has a rear curved section 22. This section directs bullets upward toward the final impact plate 14. As discussed, the transition from the flat section 21 to the curved section 22 should be smooth to prevent any bouncing or tumbling of the bullet. To ensure a smooth transition, the deflecting plate in the preferred embodiment, including both sections 21 and 22, is made from one continuous plate of steel. The radius of curvature of the curved section is also critical. Bullets tend to begin tumbling if the radius of curvature is too small. Therefore, the radius of curvature should be sufficiently large to prevent tumbling. In the preferred embodiment, a radius of 8 inches is employed.

Further regarding the curved rear section 22 of deflecting plate 12, it is preferable to construct the deflecting plate so that it alters the course of the bullet a total of approximately 75 to 80 degrees from its original horizontal flight path. Therefore, the effect of the deflecting plate is that the bullet strikes the back plate 13 at an angle of 10 to 15 degrees, wherein some of the velocity of the bullet is dissipated by its contact along the surface of the back plate. A lesser alteration will cause the bullet to strike the back wall 13 with too high an angle of incidence, which could lead to ricocheting of the bullet within the trap. It would also require that the back wall be constructed of thicker plate than is employed in the preferred embodiment, or that it be made of stronger steel than the ¼ inch steel plate with a Brinell Hardness of 400 used in the preferred embodiment. Deflection of the bullet by the deflecting plate to a total angle higher than 80 degrees is not desirable because it would increase the chance that a bullet, after leaving a lower deflecting plate, would strike the final impact plate 14 without benefit of the slowing effect of first striking the back plate 13.

A bullet that has left the face of a deflecting plate 12 will strike the back wall 13 at a low angle of incidence, as discussed above, and then strike the final impact plate 14. The angle of incidence at which the bullet will strike the final impact plate is high. For example, in the preferred embodiment, the bullet leaves the deflecting plate having had its trajectory altered 75 to 80 degrees from the horizontal flight path. The bullet travels up within the bullet trap and strikes the back wall 13 with an angle of incidence of 10 to 15 degrees. It then travels up the back wall or bounces off with a very slight angle and continues up the bullet trap until it strikes the final impact plate 14 at essentially a 90 degree angle. As a result, the vast majority of remaining kinetic energy in the bullet is expended upon impact with the final impact plate 14. After impact with the final impact plate, the bullet does not ricochet, but rather simply falls to the bottom of the bullet trap. Should any bullet fragment travel back from the final impact plate 14 toward the shooting area, it is contained in the trap by containment plates 17 and 18. After final impact, when the bullet falls to the bottom of the trap, it strikes a bottom plate 15, which is inclined so that the bullet slides down into a collection tray 16.

Collection tray 16 is removable so that when it becomes filled with lead bullets and fragments, it can be conveniently removed and the lead can be reclaimed in a safe manner.

Mounted in the top of the bullet trap is a spray nozzle 19 through which a spray or mist of suitable lubricant is injected into the atmosphere of the bullet trap. The lubricant can be any one of many varieties but preferably is non-corrosive, non-flammable, and has a viscosity similar to that of water. In the preferred embodiment, an emulsified silicone polymer anti-foaming agent is employed as the lubricant. The lubricant mist drifts down through the bullet trap, coating all the inside surfaces of the bullet trap and especially the top surfaces of the deflecting plates. In addition, a portion of the lubricant spray flows off the leading edges of the deflecting plates and falls as a curtain along the front face of the trap. As this mist falls, it captures any tiny airborne lead particles or dust, carrying them down into the collection tray. As the lubricant collects in the collection tray and in a liquid sump 26, the lead particles and dust settle to the bottom. The lubricant is then drawn off the top of the sump and recirculated through the system using known techniques. The cleansing action of the lubricant mist greatly reduces the level of airborne lead contamination which is normally found within the vicinity of bullet traps. This, of course, has obvious health benefits to any person in the vicinity of the bullet trap. It also can lead to significant savings in capital expenditure which might otherwise be required to install highly sophisticated air ventilation and filtration systems.

Referring to FIG. 2, a bullet permeable sheet 25 may be placed in front of the bullet trap to contain the curtain of lubricant mist that is falling in front of the bullet trap. This further enhances the lead containment benefit of the bullet trap of the present invention. The sheet 25 should be made of a material that allows a bullet to pass through, but substantially reseals itself after the bullet has passed. It has been determined that natural rubber is ideally suited to this application.

As referred to above, the deflecting plates are removably mounted within the bullet trap, so that in the event a deflecting plate becomes worn or pitted, it can be easily replaced. Referring to FIGS. 2, 4 and 5, in the preferred embodiment L-shaped tabs 30 and rectangular tabs 31 are mounted on the underside of the deflecting plate 12. These tabs fit over and against mounting rods or brackets 32 which are fixed at their ends to the side walls 10 and 11. By moving a deflecting plate 12 towards the rear of the bullet trap, it can then be lifted and easily removed and replaced. This modular design adds to the simplicity and low cost of the bullet trap of the preferred invention.

In the preferred embodiment, the length of the front flat section 21 of deflecting plate 12 is approximately 13½ inches and the radius of curvature of the rear curved section 22 is 8 inches. The front flat section 21 is disposed at an angle of 18 degrees from the horizontal flight path of incoming bullets and the rear curved section 22 deflects bullets an additional 60 degrees, so that the bullet is deflected a total of 78 degrees by the deflecting plate 12. The horizontal distance between the trailing edge of deflecting plate 12 and the rear wall 13 is approximately 6 inches. The deflecting plates 12 are made of ¼ inch hot-rolled steel plate, the back wall 13 is made of ¼ inch steel plate with a Brinell Hardness of 400, and the final impact plate 14 is made of ½ inch steel plate with a Brinell Hardness of 400.

It is possible to place two or more of the described bullet traps side by side so that the target area can be enlarged. When this is done, the front surfaces of the side walls of the bullet traps are subject to direct impact from incoming bullets. According to the present invention, when two bullet traps are placed side by side, the side walls are held together by suitable means and a wedge-shaped steel strip 51 is mounted along the adjoining front edges of the side walls to split bullets. Referring to FIG. 6, the side wall 10' of a first bullet trap unit is placed next to the side wall 11' of a second bullet trap unit and they are joined by suitable joining means. A leading edge strip 51 is then mounted on the front surfaces of the side walls. In the preferred embodiment, this leading edge strip 51 is mounted to the side walls 10' and 11' by welds 55 and 56 between the wedge-shaped leading edge strip and the respective side walls 10' and 11'. However, any suitable mounting means known to those skilled in the art will suffice. The angle between the wedge faces of the wedge-shaped leading edge should be approximately 30 degrees for the same reasons discussed above with respect to the leading edges 20 of the deflecting plates. This leading edge 51 preferably also has a blunt face 57, similar to the blunt face of the leading edge 20 of the deflecting plate. This leading edge 51 should be of a steel which has been suitably hardened so as to be better able to withstand impact from incoming bullets.

The inventor believes that the construction and operation of the novel apparatus described herein will now be understood and that the several advantages thereof will be fully appreciated by those persons skilled in the art.

What is claimed:

1. A bullet trap for capturing a bullet fired along a horizontal flight path comprising:

a pair of vertically disposed side walls;

a vertically disposed back wall at the rear of the bullet trap connected to the side walls;

at least one deflecting plate extending between and connected to the side walls, said deflecting plate having a forward section disposed at an upward angle of about 15 to 20 degrees from the flight path of the bullet; and a final impact plate extending between the side walls at upper ends of said side walls.

2. The bullet trap of claim 1, wherein the deflecting plate is removably attached to the side walls.

3. The bullet trap of claim 1, wherein a leading edge of said deflecting plate has a hardness sufficient to withstand impact, without deformation, from a bullet travelling at 1500 feet per second.

4. The bullet trap of claim 1, wherein a leading edge of said deflecting plate has a hardness of at least 55 Rockwell.

5. The bullet trap of claim 4, wherein said leading edge has a wedge-shaped cross section wherein the angle of the wedge is 25 to 45 degrees.

6. The bullet trap of claim 1, further comprising means for spraying a liquid lubricant into a top portion of the bullet trap, and a liquid sump in the bottom of the bullet trap for collecting the liquid lubricant.

7. A bullet trap for capturing and deenergizing a bullet fired along a substantially horizontal flight path comprising:

a pair of side walls disposed in planes substantially parallel to the path of the fired bullet;

at least one deflecting plate extending between and connected to the side walls, said deflecting plate having a planar front section including a leading edge and a trailing portion and arranged at an angle of about 15 to 20 degrees from the horizontal flight path of the bullet, and having a curved rear section adjoining the planar front section along said trailing portion thereof, wherein the combination of said planar front section and said curved rear section are dimensioned so as to deflect the fired bullet less than 90 degrees from the horizontal flight path;

a back wall connecting the side walls; and a final impact plate extending between the side walls and adjoining the back wall.

8. The bullet trap of claim 7, wherein said curved rear section of said deflection plate has a radius of curvature of no less than eight inches.

9. The bullet trap of claim 7, wherein the deflecting plate is removably attached to the side walls.

10. The bullet trap of claim 7, wherein said leading edge of the deflecting plate has a hardness sufficient to withstand impact, without deformation, from a bullet travelling at 1500 feet per second.

11. The bullet trap of claim 7, wherein said leading edge of the deflecting plate has a hardness of at least 55 Rockwell.

12. The bullet trap of claim 7, wherein said leading edge has a wedge-shaped cross section wherein the angle of the wedge is 25 to 45 degrees.

13. The bullet trap of claim 7, further comprising means for spraying a liquid lubricant into a top portion of the bullet trap, and a liquid sump in the bottom of the bullet trap for collecting the liquid lubricant.

14. The bullet trap of claims 1 or 7, wherein the side walls have a leading edge having a hardness sufficient to withstand impact, without deformation, from a bullet travelling at 1500 feet per second.

15. The bullet trap of claims 1 or 7, wherein the side walls have a leading edge having a hardness of at least 55 Rockwell.

16. The bullet trap of claims 1 or 7, wherein the side walls have a leading edge having a wedge-shaped cross section wherein the angle of the wedge is 25 to 45 degrees.

17. A bullet trap for capturing and deenergizing a bullet fired along a substantially horizontal flight path comprising:

a pair of side walls disposed in planes substantially parallel to the path of the fired bullet;

a plurality of spaced deflecting plates extending between and connected to the side walls, said deflecting plates each having a planar front section including a leading edge and a trailing portion and arranged at an angle of about 15 to 20 degrees from the horizontal flight path of the bullet, and having a curved rear section adjoining the planar front section along said trailing portion thereof, wherein the combination of said planar front section and said curved rear section are dimensioned as to deflect the fired bullet less than 90 degrees from the horizontal flight path;

a back wall connecting the side walls; and a final impact plate extending between the side walls and adjoining the back wall.

18. The bullet trap of claim 17, wherein the distance between deflecting plates is such that the bullet, traveling along its initial substantially horizontal flight path, can strike only the planar front sections of the deflecting plates.

19. A device for trapping bullets travelling along a flight path comprising:

a pair of side walls;

a back wall connected to the side walls;

a final impact plate extending between the side walls; and means for deflecting said bullet toward said final impact plate, said means initially deflecting said bullet about 20 degrees from said flight path and finally deflecting said bullet about 75 degrees from said flight path.

* * * * *